US009193128B2

(12) United States Patent
Eriksson

(10) Patent No.: US 9,193,128 B2
(45) Date of Patent: Nov. 24, 2015

(54) BOOKLET MAKING MACHINE

(75) Inventor: Lennart Eriksson, Segeltorp (SE)

(73) Assignee: PLOCKMATIC INTERNATIONAL AB, Hägersten (SE)

( * ) Notice: Subject to any disclaimer, the term of this patent is extended or adjusted under 35 U.S.C. 154(b) by 0 days.

(21) Appl. No.: 14/241,873

(22) PCT Filed: Sep. 3, 2012

(86) PCT No.: PCT/SE2012/050934

§ 371 (c)(1),
(2), (4) Date: Feb. 27, 2014

(87) PCT Pub. No.: WO2013/032399

PCT Pub. Date: Mar. 7, 2013

(65) Prior Publication Data

US 2014/0212242 A1 Jul. 31, 2014

(30) Foreign Application Priority Data

Sep. 1, 2011 (SE) ..... 1150794

(51) Int. Cl.

| | |
|---|---|
| ***B31F 5/00*** | (2006.01) |
| ***B65H 45/04*** | (2006.01) |
| ***B65H 9/06*** | (2006.01) |
| ***B65H 31/30*** | (2006.01) |
| ***B65H 37/04*** | (2006.01) |
| ***B65H 45/18*** | (2006.01) |
| ***B42B 4/00*** | (2006.01) |
| ***B42C 1/12*** | (2006.01) |
| ***B42C 19/02*** | (2006.01) |
| ***B42B 5/10*** | (2006.01) |

(52) U.S. Cl.

CPC ... *B31F 5/00* (2013.01); *B42B 4/00* (2013.01); *B42B 5/103* (2013.01); *B42C 1/12* (2013.01); *B42C 19/02* (2013.01); *B65H 9/06* (2013.01); *B65H 31/30* (2013.01); *B65H 37/04* (2013.01); *B65H 45/04* (2013.01); *B65H 45/18* (2013.01); *B65H 2404/692* (2013.01); *B65H 2405/1124* (2013.01); *B65H 2801/48* (2013.01)

(58) Field of Classification Search

CPC ..... B31F 5/00; B65H 37/04; B65H 45/04; B65H 9/06

USPC ..... 270/37, 58.08, 58.12; 412/33

See application file for complete search history.

(56) References Cited

U.S. PATENT DOCUMENTS 6,568,668 B1 * 5/2003 Wakabayashi et al. .... 270/58.11
7,111,837 B2 * 9/2006 Itou et al. ..... 270/45

(Continued)

FOREIGN PATENT DOCUMENTS

GB 801124 A 9/1958
WO WO2007120826 A2 10/2007

*Primary Examiner* — Leslie A Nicholson, III

(74) *Attorney, Agent, or Firm* — Bergenstrahle & Partners AB; Gabriela B. Tomescu, Esq.

(57) ABSTRACT

A booklet making machine is provided, comprising a stapling arrangement (10) adapted for stapling a set of sheets, and a folding arrangement (30) adapted for folding a set of sheets following a paper path. At least one of the stapling arrangement and the folding arrangement comprises an adjustment device (12; 32) for adjusting the position of the set of sheets during operation of the booklet making machine. Thereby, the quality of the stapled and folded end products can be improved during operation of the booklet making machine, without interrupting the operation of any connected apparatuses, such as a printer.

8 Claims, 5 Drawing Sheets

(56) References Cited

U.S. PATENT DOCUMENTS

| | | | | |
|---|---|---|---|---|
| 7,374,160 | B2 * | 5/2008 | Doi | 270/37 |
| 7,490,820 | B2 * | 2/2009 | Kobayashi | 270/37 |
| 7,597,311 | B2 * | 10/2009 | Kawata et al. | 270/37 |
| 7,631,860 | B2 * | 12/2009 | Asami et al. | 270/58.08 |
| 7,699,302 | B2 * | 4/2010 | Ichikawa | 270/58.12 |
| 7,926,800 | B2 * | 4/2011 | Oikawa et al. | 270/58.12 |
| 2002/0081187 | A1 | 6/2002 | Wolf | |
| 2010/0320673 | A1 | 12/2010 | Takata | |

* cited by examiner

BOOKLET MAKING MACHINE

TECHNICAL FIELD

The present invention relates generally to a booklet making machine with a stapling and folding function for sheets forming the booklet.

BACKGROUND ART

Booklet making machines comprise a sheet transport system through which paper sheets, which are intended to form a booklet, are passed. The machine also comprises a stapling arrangement, which effects stapling of a set of sheets, and a folding arrangement, which effects folding of the previously stapled set of sheets. In some cases, the operation excludes the stapling function and the set of sheets is transported to the folding arrangement in an unstapled condition.

In order to avoid misalignment of the staples, it is known to adjust the stapler head position relatively to the set of sheets to be stapled. However, this is done manually, requiring interruption of the operation of the booklet making machine. Also, in order to obtain correctly folded booklets, the position of the set of sheets to be folded can be adjusted before folding.

SUMMARY OF INVENTION

An object of the present invention is to provide a booklet making machine wherein the end result of the booklet making operation is improved without interrupting the operation of the booklet making machine.

According to the invention, a booklet making machine is provided comprising: a stapling arrangement adapted for stapling a set of sheets following a paper path, a folding arrangement adapted for folding the set of sheets following the paper path, wherein at least one of the stapling arrangement and the folding arrangement comprises at least one adjustment device for adjusting the stapling position, when the adjustment device is arranged in the stapling arrangement, and the folding position, when the adjustment device is arranged in the stapling arrangement, respectively, of the set of sheets during operation of the booklet making machine, the machine being characterized by a control unit connected to the at least one adjustment device and the operating terminal, allowing the adjustment of the stapling position and the folding position, respectively, and an operating terminal adapted to send instructions to the control unit to adjust the stapling position and the folding position, respectively, online during operation of the booklet making machine upon input from an operator online during operation of the booklet making machine. Thereby, the quality of the stapled and folded end products can be improved during operation of the booklet making machine, without interrupting the operation of any connected apparatuses, such as a printer.

In one embodiment, at least one of the adjustment device of the stapling arrangement and the adjustment device of the folding arrangement is journalled about a horizontal axis extending perpendicularly to the paper path of the booklet making machine. This allows a mechanical design which is both simple and efficient.

In one embodiment, at least one actuator, preferably an electric motor, is adapted to tilt at least one of the adjustment device of the stapling arrangement and the adjustment device of the folding arrangement.

In one embodiment, at least one of the adjustment device of the stapling arrangement and the adjustment device of the folding arrangement comprises a stop portion extending across the paper path during stapling operation and folding operation, respectively. By means of this stop portion, the position of the set of sheets is advantageously adjusted. The stop portion of the adjustment device of the stapling arrangement can be adapted to be moved to a position below the paper path during operation of the booklet making machine with folding but without stapling. This allows a flexible use of the booklet making machine.

In one embodiment, the stop portion of the stapling arrangement and/or the folding arrangement is tilted by means of a link arrangement, which is actuated by means of an eccentric connection to a rotatable shaft, driven by the actuator. In this way, the position of the stop portion can be adjusted with high accuracy.

In one embodiment, an operating terminal is adapted to graphically display at least one of the stapling position and the folding position. Thus, during operation of the booklet making machine an operator can easily adjust the operation to improve the end result of the operation.

BRIEF DESCRIPTION OF DRAWINGS

The invention is now described, by way of example, with reference to the accompanying drawings, in which.

DESCRIPTION OF EMBODIMENTS

In the following, a detailed description of embodiments of a booklet making machine according to the invention will be given.

Figure 1:
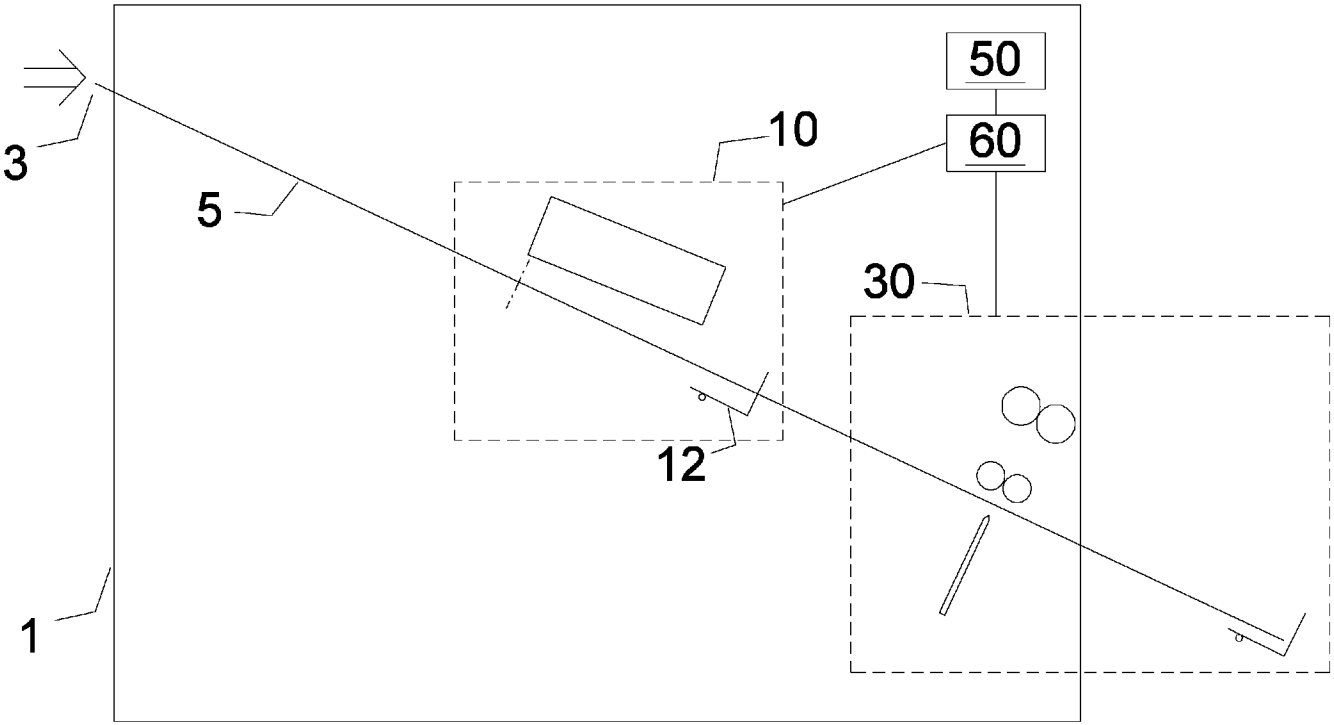
FIG. 1 is an overall sectional view of a booklet making machine according to the invention.

In FIG. 1, an overall sectional view of a booklet making machine, generally designated 1, is shown. In this figure, only the portions of the machine relevant for the present invention are shown, including a stapling arrangement, generally designated 10, and a folding arrangement, generally designated 30. Paper sheets entering the booklet making machine 1 from for example a printer (not shown) enters through a sheet entry 3 and follows a paper sheet path 5. The sheets are directed along the paper sheet path 5 by means of rolls or the like (not shown) until they reach a staple stop 12 of the stapling arrangement 10. Furthermore, the sheet path 5 is slanting so that sheets thereon are also forwarded by means of gravity force. After being subject to a stapling operation by means of the stapling arrangement 10, a set of sheets is forwarded to the folding arrangement 30 for folding.

The booklet making machine 1 also comprises an operating terminal 50 comprising a display and associated input means, such as buttons. By means of the operating terminal 50, which is connected to a control unit 60, such as a micro computer. The control unit 60 is thus connected to at least one adjustment device and the operating terminal, allowing the adjustment of the stapling position and the folding position, respectively, without interruption of the operation of the booklet making machine. Thus, an operator can input parameters relevant for the operation of the booklet making machine 1. Particularly, the operating terminal 50 is adapted to send instructions to the control unit to adjust the stapling position and the folding position, respectively, online during operation of the booklet making machine upon input from an operator online during operation of the booklet making machine. This means that the operator can adjust the stapling and/or folding position(s) in dependence to the previous stapling and/or folding of booklets provided by the machine. For example, the operator may find from visual inspection that the staples are incorrectly positioned and may then adjust the stapling position of subsequent booklets without interrupting the operation of the booklet making machine.

Stapling Arrangement

Figure 2:
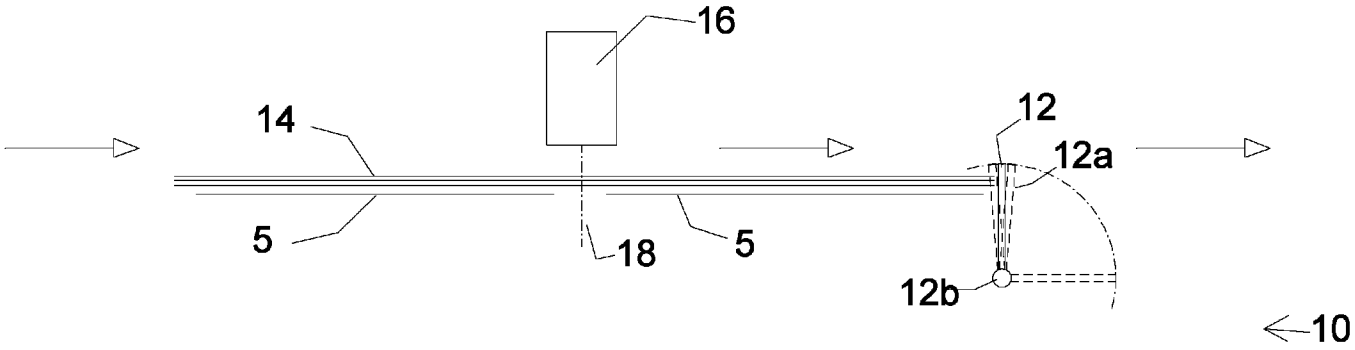
FIG. 2 is a schematic view of a stapling arrangement comprised in the booklet making machine of FIG. 1, FIGS. 3*a-c* are detailed views of a stapling arrangement in different positions.
Figure 5:
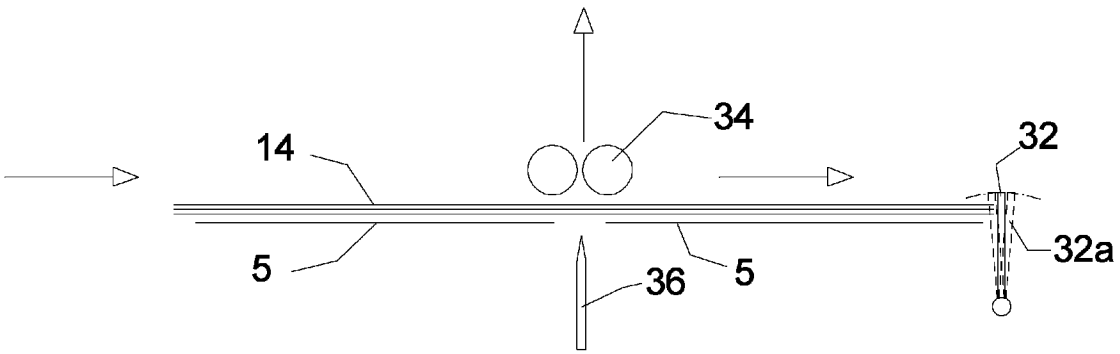
FIG. 5 is a schematic view of a folding arrangement comprised in the booklet making machine of FIG. 1, FIG. 6*a-c* are detailed views of a folding arrangement in different positions.

During operation, a number of sheets stack in the stapling arrangement so as to form a set of sheets 14 to be stapled, see FIG. 2. After stacking, the set of sheets 14 is stapled by means of a stapler 16, which operates along a staple line 18.

In order to adjust the position of the stapling of the set of sheets 14, the position thereof on the paper path can be adjusted by means of the staple stop 12. More specifically, the staple stop 12 comprises an essentially planar and tiltable stop portion 12*a*, which abuts the edges of the sheets constituting the set of sheets 14 to be stapled. The position of this stop portion 12*a* can be adjusted to allow different positions of the sheets during the stapling operation. Thus, by tilting the planar portion 12*a*, the position of the sheets is adjusted. In its simplest form, the staple stop 12 is journalled about a horizontal axis 12*b* driven by an actuator, such as an electrical motor or the like (not shown). The horizontal axis 12*b* extends perpendicularly to the extension of the paper path and is provided well below the plane of the paper path 5, preferably between 25 and 75 millimeters and more preferably at least 50 millimeters below the paper path 5. The actuator is connected to the control unit 60 and can thus be controlled by means of the operating terminal 50.

The position of the staple stop 12 can be adjusted during operation of the booklet making machine 1, offering an advantage in that the quality of the stapled sets of sheets can be improved without interrupting the operation of the booklet making machine 1 and any other apparatuses connected thereto, such as a printer.

Figure 3C:
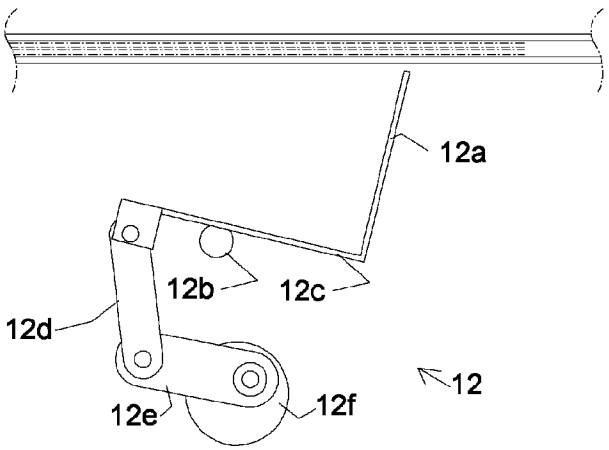
Figure 3A:
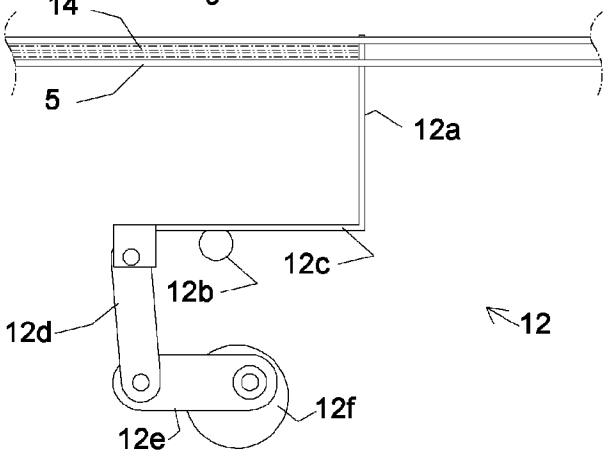

A more detailed explanation of the function of a staple stop 12 will now be given with reference to FIGS. 3*a-c*. In this embodiment, the staple stop 12 comprises the essentially planar stop portion 12*a* extending across the paper sheet path 5 during stapling operation. The stop portion forms, together with a second planar portion 12*c* extending essentially perpendicularly to the stop portion 12*a*, an L shaped part, wherein the second planar portion 12*c* is attached to a horizontal axis 12*b*. The L shaped part can be tilted by means of a link arrangement 12*d*, 12*e*, which is actuated by means of an eccentric connection to a rotatable shaft, driven by an electric motor 12*f*.

Figure 3B:
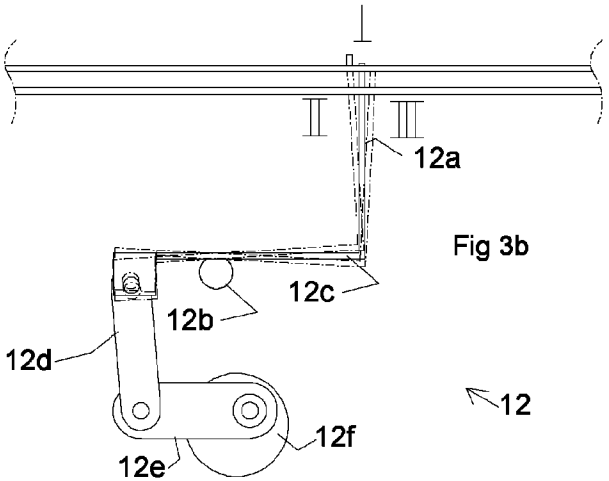

Different positions of the staple stop 12 and therewith the stop portion 12*a* are shown with dashed lines in FIG. 3*b*. The initial position shown in FIG. 3*a* is shown with solid lines and is labeled "I" in the figure. By moving the stop portion 12*a* backward to the position labeled "II", the entire set of sheets 14, see FIG. 3*a*, is moved backward on the paper path, thereby adjusting the position of the staples provided by the stapler 16. Alternatively, by moving the stop portion 12*a* forward to the position labeled "III", the entire set of sheets 14, see FIG. 3*a*, is moved forward on the paper path by gravity force, thereby adjusting the position of the staples provided by the stapler 16 in a direction opposite to the adjustment provided by movement to position "II".

Figure 4B:
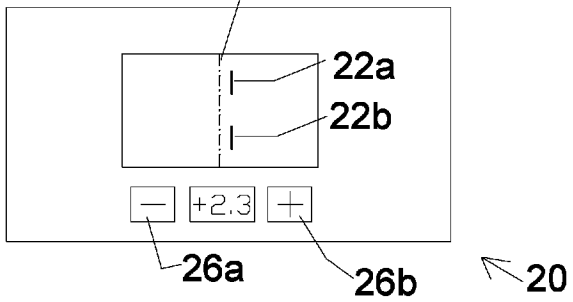
FIGS. 4*a* and 4*b* show a display used during operation of the stapling arrangement.
Figure 4A:
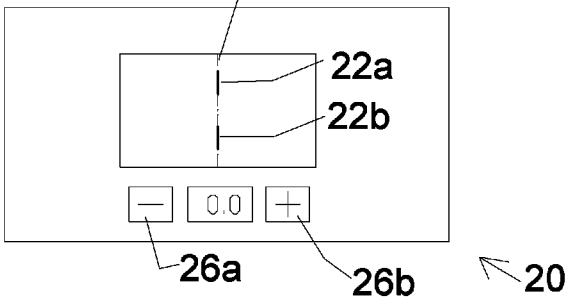

This adjustment of the stapling position may be displayed graphically on an operator display 20, see FIGS. 4*a* and 4*b*, which is optionally comprised in the operating terminal 50. In FIG. 4*a*, the initial stapling position is displayed graphically as two straight lines 22*a*, 22*b*, representing the two staples, relative to the center line 24 of the sheet to be stapled. The display, being a touch screen, shows two touch buttons 26*a*, 26*b*, used for adjusting the stapling position in a forward and backward direction, respectively. Thus, by pressing the minus button 26*a* the staple position is moved to the left and by pressing the plus button 26*b* the staple position is moved to the right, see FIG. 4*b*. Since this adjustment can be made on-line during operation of the booklet making machine 1, the operator can review the stapled product and adjust the staple position accordingly, should the present staple position be incorrect.

In some cases, the stapling operation should be omitted and the set of sheets 14 is to be folded only, without any staples. In this case, the stop portion 12*a* of the staple stop 12 can be moved to a position below the paper path, see FIG. 3*c*. By moving the stop portion 12*a* to this position, sheets forwarded on the paper path 5 are allowed to move forward there along without any interruption in the stapling arrangement.

Folding Arrangement

After being stapled by means of the stapling arrangement 10 or optionally without being stapled, the set of sheets 14 is forwarded to the folding arrangement for subsequent folding.

During operation, the set of sheets forwarded from the stapling arrangement 10 is folded by means of a combination of fold rollers 34 and a fold knife 36, which operates along a fold line 38.

Similar to the stapling operation, in order to adjust the position of the folding of the set of sheets 14, the position thereof on the paper path can be adjusted by means of a folding stop 32 comprised in the folding arrangement 30. More specifically, the folding stop 32 comprises an essentially planar and tiltable stop portion 32*a*, which abuts the edges of the sheets constituting the set of sheets 14 to be folded. The position of this stop portion 32*a* can be adjusted to allow different positions of the sheets during the folding operation. Thus, by tilting the planar portion 32*a*, the position of the sheets is adjusted. In its simplest form, the folding stop 32 is journalled about a horizontal axis 32*b* driven by an actuator in the form of an electrical motor or the like (not shown). The horizontal axis 32*b* extends perpendicularly to the extension of the paper path and is provided below the plane of the paper path 5, preferably between 25 and 75 millimeters and more preferably at least 50 millimeters below the paper path 5.

The position of the folding stop 32 can be adjusted during operation of the booklet making machine 1, offering an advantage in that the quality of the folded sets of sheets can be improved without interrupting the operation of the booklet making machine 1 and any other apparatuses connected thereto, such as a printer.

A more detailed explanation of the function of a folding stop 32 will now be given with reference to FIGS. 6*a-c*. In this embodiment, the folding stop 32 comprises the essentially planar stop portion 32*a* extending across the paper sheet path 5 during folding operation. The stop portion 32*a* is integral with two second planar portions 32*c*, one of which is shown in the figures, extending from the stop portion 32*a*, one on either side of the paper path 5. The second planar portions 32*c* are attached to a horizontal axis 32*b* extending across and below the paper path 5. The stop portion 32*a* and the two second planar portion 32*c* can be tilted by means of a link arrangement 32*d*, which is actuated by means of an eccentric connection to a rotatable shaft 32*f*, driven by an actuator in the form of an electric motor or the like (not shown). The actuator is connected to the control unit 60 and can thus be controlled by means of the operating terminal 50.

Figure 6C:
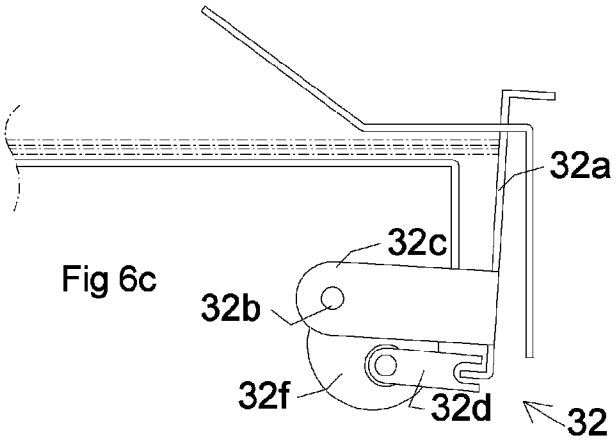
Figure 6A:
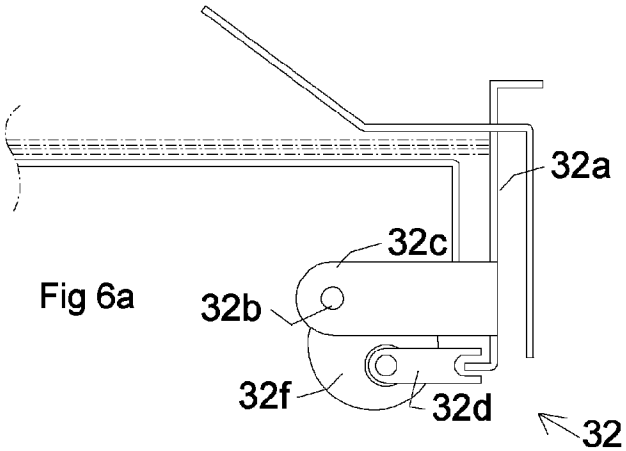
Figure 6B:
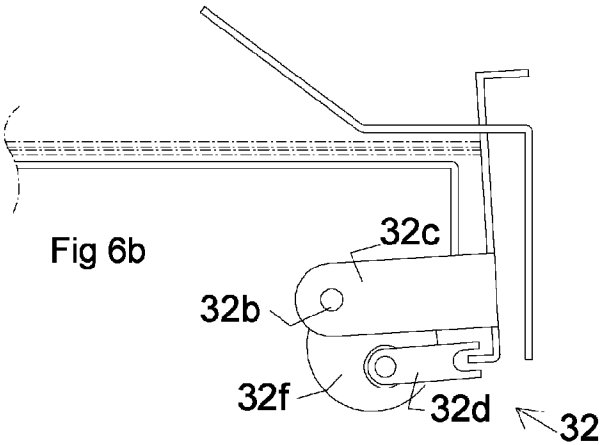

Different positions of the folding stop 32, and therewith the stop portion, 32*a* are shown in FIGS. 6*a-c*. The initial position is shown in FIG. 6*a*. By moving the stop portion 32*a* backward to the position shown in FIG. 6*b*, the entire set of sheets 14 is moved backward on the paper path, thereby adjusting the position of the folding provided by the combination of fold rollers 34 and the fold knife 36. Alternatively, by moving the stop portion 32*a* forward to the position shown in FIG. 6*c*, the entire set of sheets is moved forward on the paper path by the gravity, thereby adjusting the position of the folding provided by the combination of fold rollers 34 and the fold knife 36 in a direction opposite to the adjustment provided by movement to the position shown in FIG. 6*b*.

Figure 7B:
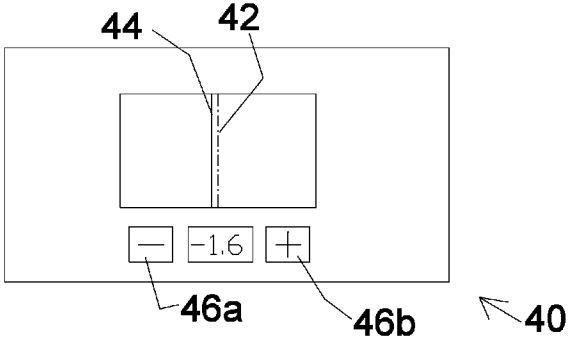
FIGS. 7*a* and 7*b* show a display used during operation of the folding arrangement.
Figure 7A:
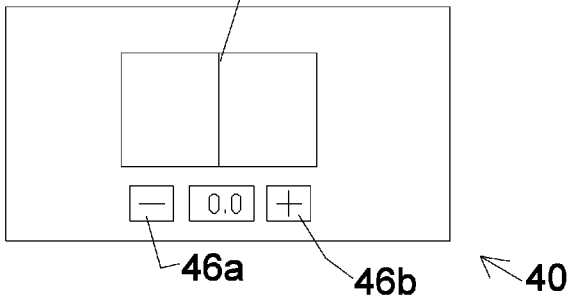

This adjustment of the folding position is displayed graphically on an operator display 40, see FIGS. 7*a* and 7*b*. In FIG. 7*a*, the initial folding position is displayed graphically as aligned with the center line 44 of the sheet to be folded. The display, being a touch screen, shows two touch buttons 46*a*, 46*b*, used for adjusting the folding position in a forward and backward direction, respectively. Thus, by pressing the minus button 46*a* the folding position is moved to the left and by pressing the plus button 26*b* the folding position is moved to the right, see FIG. 7*b*, wherein the folding line 42 is shown as a dash-dotted line. Since this adjustment can be made on-line during operation of the booklet making machine, the operator can review the folded product and adjust the folding position accordingly, should the present folding position be incorrect.

Preferred embodiments of a booklet making machine according to the invention have been described. It will be appreciated that these can be modified without departing from the inventive idea as defined by the appended claims. Thus, although a booklet making machine having both an adjustable stapling arrangement and an adjustable folding arrangement has been described, a booklet making machine having the adjustment function on only one of these arrangements is also possible.

The invention claimed is:

1. A booklet making machine comprising:

a stapling arrangement adapted for stapling a set of sheets following a paper path, wherein the set of sheets is stapled in a stapling position;

a folding arrangement adapted for folding the set of sheets following the paper path, wherein the set of sheets is folded in a folding position;

at least one adjustment device for adjusting at least one of the stapling position and the folding position of the set of sheets during an operation of the booklet making machine;

an operating terminal, adapted to receive online input from an operator during the operation of the booklet making machine and send online instructions for adjusting at least one of the stapling position and the folding position;

a control unit connected to the at least one adjustment device and the operating terminal, receiving instructions from the operating terminal for allowing the adjustment of the at least one of the stapling position and the folding position; and at least one actuator connected to the control unit and adapted to tilt at least one of the adjustment device for adjusting the stapling position and the adjustment device for adjusting the folding position.

2. The booklet making machine according to claim 1, wherein at least one of the adjustment device for adjusting the stapling position and the adjustment device for adjusting the folding position is journalled about a horizontal axis extending perpendicularly to the paper path of the booklet making machine.

3. The booklet making machine according to claim 1, wherein the actuator comprises an electric motor.

4. The booklet making machine according to claim 1, wherein at least one of the adjustment device of the stapling arrangement and the adjustment device of the folding arrangement comprises a stop portion extending across the paper path during a stapling operation and a folding operation, respectively.

5. The booklet making machine according to claim 4, wherein the stop portion of the adjustment device of the stapling arrangement is adapted to be moved to a position below the paper path during operation of the booklet making machine with folding but without stapling.

6. The booklet making machine according to claim 4, wherein the stop portion is tilted by means of a link arrangement, the link arrangement being actuated by means of an eccentric connection to a rotatable shaft, driven by the actuator.

7. The booklet making machine according to claim 1, wherein the operating terminal is adapted to graphically display at least one of the stapling position and the folding position.

8. The booklet making machine according to claim 1, wherein the adjustment device is adapted to adjust the position individually for each booklet in a flow of booklets, wherein both the stapling position and the folding position are adjusted when the adjustment device is arranged in the stapling arrangement.

* * * * *